US007249701B2

(12) United States Patent
Losada

(10) Patent No.: US 7,249,701 B2
(45) Date of Patent: Jul. 31, 2007

(54) POWER ACTUATED GUN WITH FASTENER FEEDING TRACK AND AUTOMATIC FIRING

(75) Inventor: Alfonso Losada, Bridgeport, CT (US)

(73) Assignee: Simpson Strong-Tie Co., Inc., Pleasanton, CA (US)

( * ) Notice: Subject to any disclaimer, the term of this patent is extended or adjusted under 35 U.S.C. 154(b) by 0 days.

(21) Appl. No.: 10/703,223

(22) Filed: Nov. 5, 2003

(65) Prior Publication Data

US 2004/0188490 A1 Sep. 30, 2004

Related U.S. Application Data

(60) Provisional application No. 60/423,826, filed on Nov. 5, 2002.

(51) Int. Cl.
*B25C 1/18* (2006.01)

(52) U.S. Cl. ..... 227/11; 227/18; 227/119; 227/136

(58) Field of Classification Search ..... 227/9, 227/11, 107, 113, 114, 120, 18, 119, 136
See application file for complete search history.

(56) References Cited

U.S. PATENT DOCUMENTS

| | | | |
|---|---|---|---|
| 98,438 | A | 12/1869 | Smith, Jr. |
| 729,336 | A | 5/1903 | Hass |
| 1,213,970 | A | 1/1917 | Sturtevant |
| 1,237,422 | A | 8/1917 | Turpin |
| 1,476,836 | A | 12/1923 | Pleister |
| 2,298,560 | A | 10/1942 | Harrison |
| 2,417,245 | A | 3/1947 | Eggert et al. |
| 2,735,470 | A | 2/1956 | Poupitch |
| 2,768,552 | A | 10/1956 | MacDonald |
| 2,835,128 | A | 5/1958 | Herrstrum |
| 2,961,210 | A | 11/1960 | Pfaff et al. |
| 2,968,984 | A | 1/1961 | De Caro |
| 2,984,442 | A | 5/1961 | Lawson |

(Continued)

FOREIGN PATENT DOCUMENTS

| | | |
|---|---|---|
| AU | 484427 | 8/1976 |

(Continued)

OTHER PUBLICATIONS

Hydrajaws Limited, "Portable Tension Tester," Hydrajaws Testing Division, Rotadex Systems Limited (Birmingham, U.K.), total of 4 pages, (at least as early as Mar. 6, 2000).

(Continued)

*Primary Examiner*—Sameh H. Tawfik
*Assistant Examiner*—Gloria R. Weeks
(74) *Attorney, Agent, or Firm*—Law Offices of James R. Cypher

(57) ABSTRACT

An automated power actuated gun which drives a fastener assembly having a plate frictionally engaging a nail or stud into a hard substrate or surface such as concrete that has attached thereto a fastener feeding assembly. The fastener feeding assembly is formed with a spring-biased holder that holds the fastener assembly to be driven until the barrel is in position for driving the fastener assembly. The fastener feeding assembly is attached directly to the barrel of the power actuated gun. The fastener feeding assembly is formed with a window at the point where the fastener assembly to be driven is received by the barrel of the power actuated gun allowing the fastener feeding track to be used with fastener assemblies having legs that can bend inwardly when the fastener assembly is driven.

1 Claim, 5 Drawing Sheets

U.S. PATENT DOCUMENTS 3,104,645 A 9/1963 Harrison
3,157,884 A 11/1964 Decot et al.
3,161,174 A 12/1964 Harrison
3,174,386 A 3/1965 Lewis
3,187,621 A 6/1965 Turner
3,212,388 A 10/1965 Rosselet
3,232,569 A 2/1966 Deardorf
3,285,120 A 11/1966 Kartiala
3,306,154 A 2/1967 Bailey
3,452,637 A 7/1969 O'Brien
3,469,492 A 9/1969 Dahl
3,476,010 A 11/1969 Markey
3,491,972 A 1/1970 Townshend
3,506,178 A 4/1970 Brunelle
3,554,246 A 1/1971 Halstead
3,602,976 A 9/1971 Grube
3,633,810 A 1/1972 Krakauer et al.
3,638,892 A 2/1972 Boye et al.
3,728,933 A 4/1973 Grube
3,734,377 A * 5/1973 Munn ..... 227/120
3,828,925 A 8/1974 Magyar
3,845,860 A 11/1974 Ladouceur et al.
3,921,495 A 11/1975 Braun et al.
3,948,141 A 4/1976 Shinjo
4,000,681 A 1/1977 Coldren
4,014,488 A 3/1977 Potucek
4,020,734 A 5/1977 Bell
4,037,515 A 7/1977 Kesselman
4,037,516 A 7/1977 Hart
4,047,463 A 9/1977 Coldren
4,062,388 A 12/1977 DeCaro
4,102,238 A 7/1978 Thurner
4,149,446 A 4/1979 Spengler et al.
4,246,939 A 1/1981 Boegel
4,287,656 A 9/1981 Gassman et al.
4,303,001 A 12/1981 Trungold
4,339,065 A 7/1982 Haytayan
4,370,082 A 1/1983 Sundberg
4,389,012 A 6/1983 Grikis et al.
4,424,929 A 1/1984 Weis
4,479,599 A 10/1984 Conrad
4,485,952 A * 12/1984 Weis ..... 227/7
4,494,412 A 1/1985 Hardy
4,655,423 A 4/1987 Schavilje et al.
4,684,022 A * 8/1987 Potucek ..... 206/347
4,703,711 A 11/1987 Haynes
4,703,883 A 11/1987 Losada
4,709,842 A 12/1987 Westerlund
4,729,703 A 3/1988 Sato
4,736,923 A 4/1988 Losada
4,824,003 A 4/1989 Almeras et al.
4,870,750 A 10/1989 Zahn
4,887,948 A 12/1989 Calmettes
4,889,457 A 12/1989 Hageman
4,907,928 A 3/1990 Beck et al.
4,915,561 A 4/1990 Buhri et al.
4,930,623 A 6/1990 Johnson et al.
4,930,673 A 6/1990 Pfister
4,932,819 A 6/1990 Almeras
4,936,843 A 6/1990 Sohngen
4,979,857 A 12/1990 Wing
4,998,660 A 3/1991 Kanzaka
5,015,132 A 5/1991 Turner et al.
5,052,607 A 10/1991 Dutton
5,110,247 A 5/1992 Losada
5,135,152 A * 8/1992 Uno et al. ..... 227/116
5,144,870 A * 9/1992 Nick ..... 81/434
5,178,503 A 1/1993 Losada
5,199,625 A 4/1993 Dewey et al.
5,199,835 A 4/1993 Turner
5,228,250 A 7/1993 Kesselman
5,261,770 A 11/1993 Hoepker et al.
5,292,216 A 3/1994 Van Allman
5,328,300 A 7/1994 Fischer et al.
5,370,483 A 12/1994 Hood et al.
5,417,534 A 5/1995 Losada
5,425,488 A 6/1995 Thompson
5,443,345 A 8/1995 Gupta
5,452,835 A 9/1995 Shkolnikov
5,479,830 A 1/1996 Gemra
5,487,632 A 1/1996 Hood et al.
5,497,929 A 3/1996 Armstrong
5,525,018 A 6/1996 Losada
5,554,131 A 9/1996 Lacivita
5,568,753 A 10/1996 Habermehl et al.
5,579,975 A 12/1996 Moorman
5,597,972 A 1/1997 Wachter
5,624,200 A 4/1997 Beaulieu
5,634,583 A 6/1997 McGuinness et al.
5,634,756 A 6/1997 Losada
5,669,589 A 9/1997 Janssen et al.
5,697,431 A 12/1997 Nagasaka
5,704,572 A 1/1998 Vogel et al.
5,758,465 A 6/1998 Logue
5,769,581 A 6/1998 Wallace et al.
5,773,722 A 6/1998 Helderman
5,788,444 A 8/1998 Losada
5,810,239 A 9/1998 Stich
5,829,661 A 11/1998 Hirtl et al.
5,885,034 A 3/1999 Fergusson
5,890,857 A 4/1999 Herrera
5,897,082 A 4/1999 Losada
5,913,647 A 6/1999 Hodge
5,931,618 A 8/1999 Wallace et al.
6,055,891 A * 5/2000 Habermehl ..... 81/434
6,273,316 B1 * 8/2001 Losada ..... 227/119
6,296,166 B1 * 10/2001 Huang ..... 227/119
6,481,611 B2 11/2002 Losada
6,685,078 B2 * 2/2004 Wohlwend et al. ..... 227/120
6,761,299 B2 * 7/2004 Caringella et al. ..... 227/10
2001/0000404 A1 4/2001 Losada
2003/0133768 A1 7/2003 Losada
2004/0188489 A1 9/2004 Losada

FOREIGN PATENT DOCUMENTS

AU 743441 11/1998
BE 0518452 3/1953
DE 1603703 9/1970
DE 2504816 8/1975
EP 0 100 555 2/1984
FR 1047890 12/1953
GB 194 2/1898
GB 1 384 511 2/1975
GB 2 195 453 A 4/1988
GB 2 229 242 A 9/1990
JP 46-1521 1/1971
WO WO 97/29288 8/1997
WO WO 98/47668 10/1998
WO WO 2003/059578 A2 7/2003

OTHER PUBLICATIONS

Beth-Fast, "Direct Tension Indicators," Beth-Fast (U.S.A.), total of 6 pages, (at least as early as Feb. 29, 2000).
Applied Bolting Technology Products, Inc., "Applied Bolting Technology," the best way to bolt . . . Direct Tension Indicators for Bolting Quality Assurance, Applied Bolting Technology Products, Inc. (Ludlow, VT), total of 12 pages.
Gary R. Harris, "Hold Down System Using Calibrated Compression," (Oakland, California), total of 19 pages.
Salon Conical Compression Washers, "On Washer," total of 2 pages,.

* cited by examiner

POWER ACTUATED GUN WITH FASTENER FEEDING TRACK AND AUTOMATIC FIRING

This application claims the benefit of U.S. Provisional Application No. 60/423,826, filed Nov. 5, 2002.

BACKGROUND OF THE INVENTION

Power actuated guns are used in many industrial applications, and particularly construction applications. A power actuated gun is often used to drive a fastener into a relatively hard substrate, such as concrete. The power actuated gun is typically powered by an explosive charge.

Often, with power actuated guns, a fastener is used having a nail frictionally retained in a shaped washer or plate, often called a fastener assembly. Often, an angled plate having a hole therein is used so that a wire or other device can be fastened thereto. One such fastener assembly is disclosed in U.S. Pat. No. 4,736,923 entitled "Fastener Assembly", issued to Also Loss on Apr. 12, 1988. U.S. Pat. No. 4,736,923 is incorporated herein by reference.

Fastener assemblies having a nail frictionally retained in a washer or plate are generally available loosely packed. With most power actuated guns driving fastener assemblies of this type, the fastener assemblies are placed into the barrel of the gun individually by hand. This can be time consuming.

U.S. Pat. Nos. 6,273,316 and 6,481,611, also granted to Alfonso Losada, teach a fastener feeding track and system for automatically feeding fastener assemblies having a nail frictionally retained in a washer or plate into the barrel of the power actuated gun. U.S. Pat. No. 6,273,316, granted to Alfonso Losada, on Aug. 14, 2001, is incorporated herein by reference.

The use of fastener feeding systems is especially helpful for driving fasteners into ceilings areas that are hard to reach from the ground or floor. In use, the fastener assembly is placed within or partially within the barrel of the power actuated gun and placed adjacent the surface into which the nail of the fastener assembly will be driven. The surface is generally a hard surface which requires the use of the power actuated gun. The power actuated gun is then fired, driving the stud or nail into the hard surface. The fastener feeding system then loads another fastener assembly into the barrel or at least partially into the barrel so that it is ready for firing.

For ceiling applications, the power actuated gun is often placed on a pole with a fastener assembly received within or partially within the bore of the barrel of the gun and the whole device is raised to the ceiling with a pole. When the fastener assembly lies adjacent and in contact with the ceiling where it is to be driven the gun is fired and the nail or stud of the fastener assembly is driven. Because the power actuated gun is placed on a pole, this means it is often removed from the reach of the operator. Because the power actuated gun will be raised on a pole above the operator, it is important that fastener feeding track be securely attached to the power actuated gun without interfering with the operation of the gun, and that the fastener feeding assembly work efficiently without jamming.

The present invention teaches means for securing a fastener feeding track to a power actuated gun. A number of other systems have been devised by the inventor of the present invention for improving the fastener assemblies used with power actuated guns, the operation of automatically loading fastener assemblies into the barrel of a power actuated gun and the firing the gun. Some of these inventions are described in U.S. patent application Ser. No. 09/729,389, filed Dec. 4, 2000, by Alfonso Losada, entitled "Power Actuated Fastener System", which is herein incorporated by reference. Some of these inventions are also described in U.S. patent application Ser. No. 10/043,669, filed Jan. 11, 2002, entitled "Fastener Assembly having Grooves for use with a Power Actuated Gun", filed by Alfonso Losada, which is herein incorporated by reference.

The present invention also teaches an improved fastener feeding track that is less likely to jam when used with certain fastener assemblies.

The present invention aims to increase worker productivity, allowing workers to install more fastener assemblies in a a safe and accurate manner. Worker productivity is a key economic factor in the construction industry where labor is a larger portion of the cost of any structure, and labor costs continue to rise.

SUMMARY OF THE INVENTION

It is an object of the present invention, to provide a power actuated gun having a fastener feeding track assembly attached thereto where the barrel is attached to the fastener feeding track assembly such that the barrel can move with respect to the fastener feeding track assembly.

It is an additional object of the present invention to provide the fastener feeding track assembly with a fastener assembly holder which is positioned in relation to the barrel of the power actuated gun such that the fastener assembly holder is pivoted by the barrel of the power actuated gun when the barrel has received a fastener assembly and the barrel is moved with respect to the fastener feeding track assembly.

It is an additional object of the present invention to form the fastener assembly holder with a groove to accommodate fastener assemblies having a nail projecting therefrom.

It is a further object of the device of the present invention to use a spring to bias the fastener assembly holder into a position where the fastener assembly holder is pivoted by the barrel of the power actuated gun when the barrel has received a fastener assembly and the barrel is moved with respect to the fastener feeding track assembly.

It is a further object of the present invention to teach a connection between the barrel of a power actuated gun and a fastener feeding track assembly wherein the barrel has a slot therein and the fastener feeding track assembly has a projection that is received by the slot in the barrel.

In one preferred embodiment, this projection is a screw.

It is a further object of the present invention to teach a connection between the barrel of a power actuated gun and a fastener feeding track wherein a spring biases the power actuated gun away from the fastener feeding track assembly.

When the spring between the fastener feeding track assembly and the power actuated gun compresses the barrel slides in relation to the fastener feeding track assembly.

It is a further object of the present invention to teach a connection between the barrel of a power actuated gun and a fastener feeding track assembly wherein the barrel has a pair of opposing flat surfaces therein and the fastener feeding track assembly has a pair of opposing surfaces dimensioned to closely correspond to the opposing flat surfaces of the barrel, such that the fastener feeding track assembly grips the barrel of the power actuated gun at the opposing flat surface on the barrel.

In the preferred embodiment of this form of the invention, the pair of opposing surfaces dimensioned to closely correspond to the opposing flat surface of the barrel of the fastener feeding track assembly are formed on a U shaped bracket received by the fastener feeding track assembly.

It is a further object of the present invention to provide a a power actuated gun having a fastener feeding track assembly attached thereto where the barrel is received by the fastener feeding track assembly and the fastener feeding track assembly has a window in the fastener feeding track assembly where the barrel is received by the fastener feeding track assembly.

It is a further object of the present invention that this window is large enough to create a clearance for the leg of a fastener assembly, should the leg of the fastener assembly bend toward the fastener feeding track assembly when the fastener assembly is driven by the power actuated gun.

Accordingly, it is an object of the present invention to make laborers or workers more productive and thereby reduce construction costs.

It is another object of the present invention to provide a power actuated fastening system that has a smooth operation and is easy to use.

It is a further object of the present invention to use the relative movement between the power actuated gun and an attachment to automate the loading of fastener assemblies into the power actuated gun.

It is a further object of the present invention to provide a power actuated fastener system that is safe to use.

It is an advantage of the present system that it saves time.

DETAILED DESCRIPTION OF THE INVENTION

Figures 1, 1A, 1B:
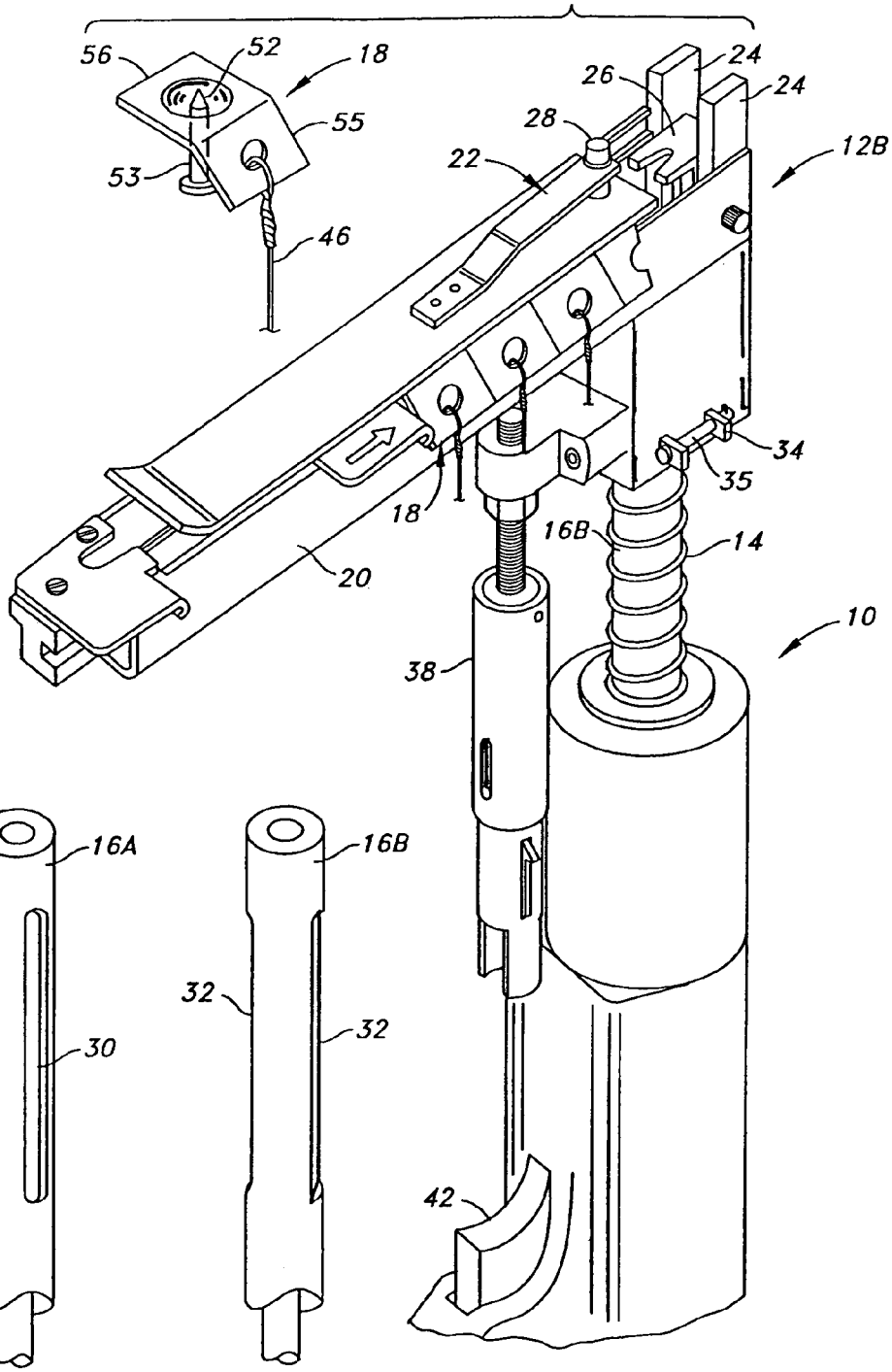
FIG. 1 is a perspective view, illustrating a power actuated gun with a fastener feeding track thereon.
FIG. 1A is a perspective view of a first type of barrel.
FIG. 1B illustrates a second type of barrel.

FIG. 1 illustrates a power actuated gun 1 having a barrel 16B. Attached to barrel 16B is a track assembly 12B.

The track assembly 12B is pushed upward on the barrel 16B by spring 14 away from the power actuated gun 10. The track assembly 12B comprises a track 20B containing a plurality of fastener assemblies 18.

The fastener assemblies 18 may have a wire 46 attached thereto.

The barrel 16B is attached to the fastener feeding track assembly 12B in such a manner that the barrel 16B can move with respect to the fastener feeding track assembly 12B.

Figure 3:
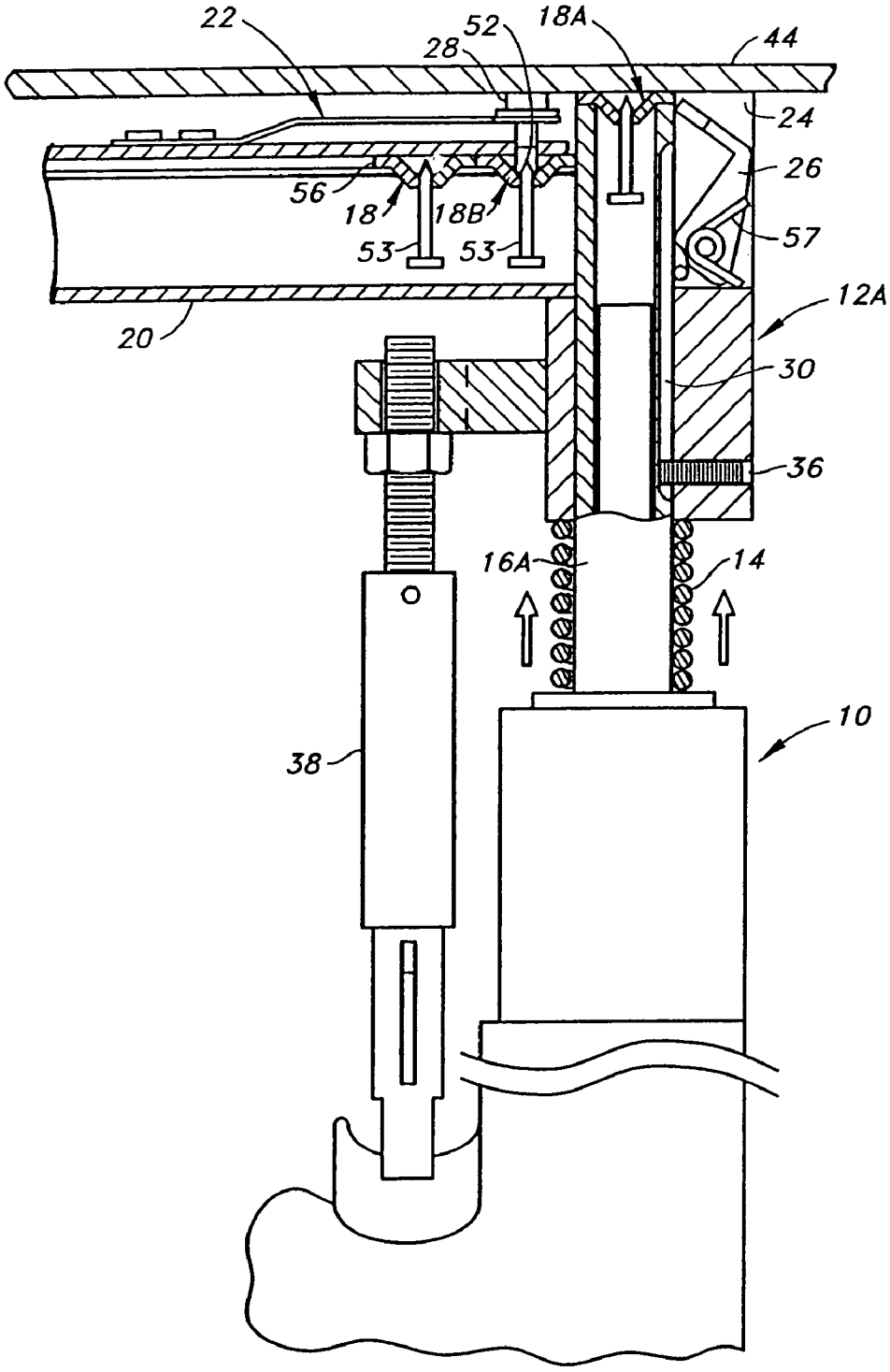
FIG. 3 is a partial cross section illustrating the operation of the track assembly attached to the barrel of a power actuated gun.

As shown in FIG. 3, the fastener feeding track assembly 12B has a fastener assembly holder 26 which is positioned in relation to the barrel 16B of the power actuated gun 10 such that the fastener assembly holder 26 is pivoted by the barrel 16B of the power actuated gun 10 when the barrel 16B has received a fastener assembly 18A and the barrel 16B is moved with respect to the fastener feeding track assembly 12B.

As shown in FIG. 1, preferably, the fastener assembly holder 26 has a groove 51 to accommodate fastener assemblies 18 having a nail 53 projecting therefrom.

A spring 57 biases the fastener assembly holder 26 into a position where the fastener assembly holder 26 is pivoted by the barrel 16B of the power actuated gun 10 when the barrel 16B has received a fastener assembly 18A and the barrel 16B is moved with respect to the fastener feeding track assembly 12B.

Once loaded in the track assembly 12B, the fastener assemblies 18 are pushed forward, contacting a holder 26. The holder 26 is pivotally attached and spring loaded to the track assembly 12B. The holder 26 may have a V groove 51 therein to hold the pointed end 52 of a nail or a stud 53 on one of the fastener assemblies 18.

Preferably, the track assembly 12B is formed with a fastener assembly stop 22. The stop 22 has a contact 28 that is forced against the pointed end 52 of a nail or stud 53 of a fastener assembly 18B that is next in line to be driven, holding the fastener assembly 18B in position. The fastener assembly stop 22 prevents the fastener assembly 18B that is next in line to be fired, from advancing into a firing position before the barrel 16B has moved out of position. This helps prevent jamming and helps prevent an advancing fastener assembly 18B from striking the barrel 16B after the firing of the preceding fastener assembly 18A.

Fastener assembly stop 22 is made from spring steel so that it can move up and down and is normally biased away from the track 20 until the power actuated gun 10 is place in position for firing and contact 28 hits a surface, forcing it downward toward the track assembly 12B.

Feet 24, mounted on the track assembly 12B, in combination with the contact 28 of the fastener assembly stop 22 form three legs for stabilizing the track assembly 12B and power actuated gun 10 over a surface into which a fastener assembly 18 is to be driven.

When firing the power actuated gun 10, the barrel 16B is caused to move upward within the track assembly 12B, pushing a fastener assembly 18A out through holder 26 which pivots, permitting the fastener assembly 18A to pass therethrough.

Figure 2:
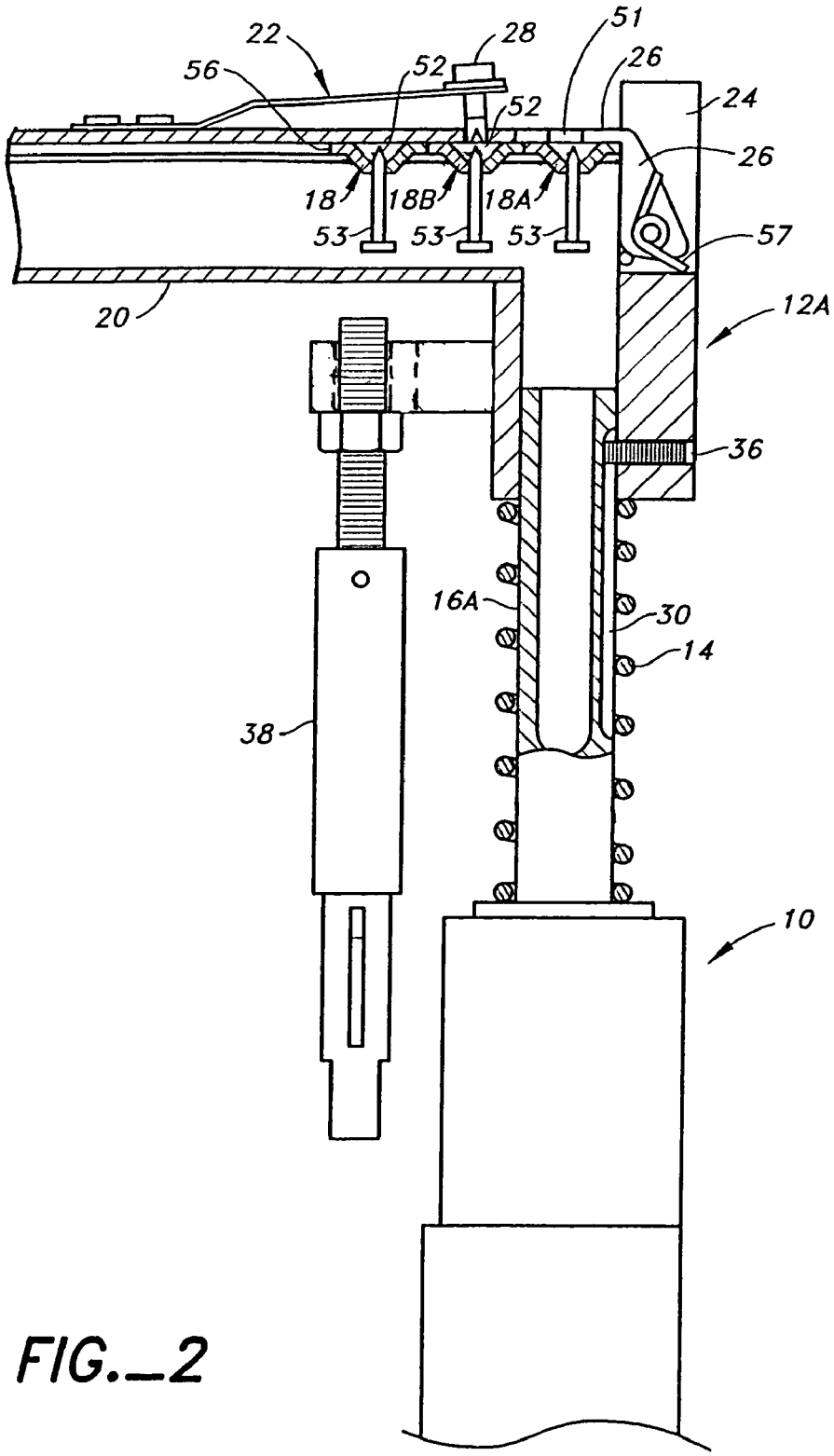
FIG. 2 is a partial cross section illustrating a track assembly attached to the barrel of a power actuated gun.

As shown in FIGS. 1 and 2, a trigger firing mechanism 38 may be used to depress a trigger 42 as the power actuated gun 10 is moved upward closer to the track assembly 12B.

The barrels 16A and 16B shown in FIGS. 1A and 1B illustrate different barrel types for attaching track assemblies 12A and 12B thereto.

FIG. 1A illustrates a barrel 16A having a slot 30 therein. The barrel 16A utilizes a screw 53 riding within a groove or slot 30 for retaining track assembly 12A thereon. In this one preferred embodiment of the connection between the barrel 16A of a power actuated gun 10 and a fastener feeding track assembly 12A the barrel 16A has a slot 30 therein and the fastener feeding track assembly 12A has a projection 53 that is received by the slot 30 in the barrel 16A.

FIG. 1B illustrates a barrel 16B having opposing flat surfaces 32. As shown in FIG. 1*b*, the connection between the barrel 16B of a power actuated gun 10 and a fastener feeding track assembly 12B is accomplished by means of forming the barrel 16B with a pair of opposing flat surfaces 32 therein and the fastener feeding track assembly 12B has a pair of opposing surfaces 58 dimensioned to closely correspond to the opposing flat surfaces 32 of the barrel 16B, such that the fastener feeding track assembly 12B grips the barrel 16B of the power actuated gun 10 at the opposing flat surfaces 32 on the barrel 16B.

In the preferred embodiment of this form of the invention, the pair of opposing surfaces 58 dimensioned to closely correspond to the opposing flat surface 32 of the barrel 16B of the fastener feeding track assembly 12B are formed on a U shaped bracket 34 received by the fastener feeding track assembly 12B.

As shown in FIG. 1B, in an alternate preferred embodiment, the track assembly 12B can be held onto barrel 16B by U shaped bracket 34. The barrel 16B illustrated in FIG. 1B utilizes a U shaped bracket to ride within the flat surfaces 32 for holding track assembly 12B thereon.

FIG. 2 illustrates a fastener assembly 18 in a firing position held in place by holder 26 pushing the fastener assembly 18A against the track 20A. In this embodiment, the track assembly 12A is held onto the barrel 16A with a screw 36 riding in groove or slot 30. The contact 28 of the fastener assembly stop 22 is in a raised position biasing by a leaf spring 54 forming a part of the fastener assembly stop 22.

FIG. 3 illustrates the operation of the track assembly 12A. The track assembly 12A is attached to the barrel 16A of the power actuated gun 10 with a screw 36 riding in slot 30 on the barrel 16A. As the feet 24 and contact 28 come into contact with a surface 44, barrel 16A advances compressing spring 14. The barrel 16A pushes on a fastener assembly 18A. The holder 26 pivots away and the fastener assembly 18A is held against the surface 44 in firing position. The contact 28 of the fastener assembly stop 22 is forced downward to hold an adjacent fastener assembly 18B, preventing it from advancing.

Figure 4:
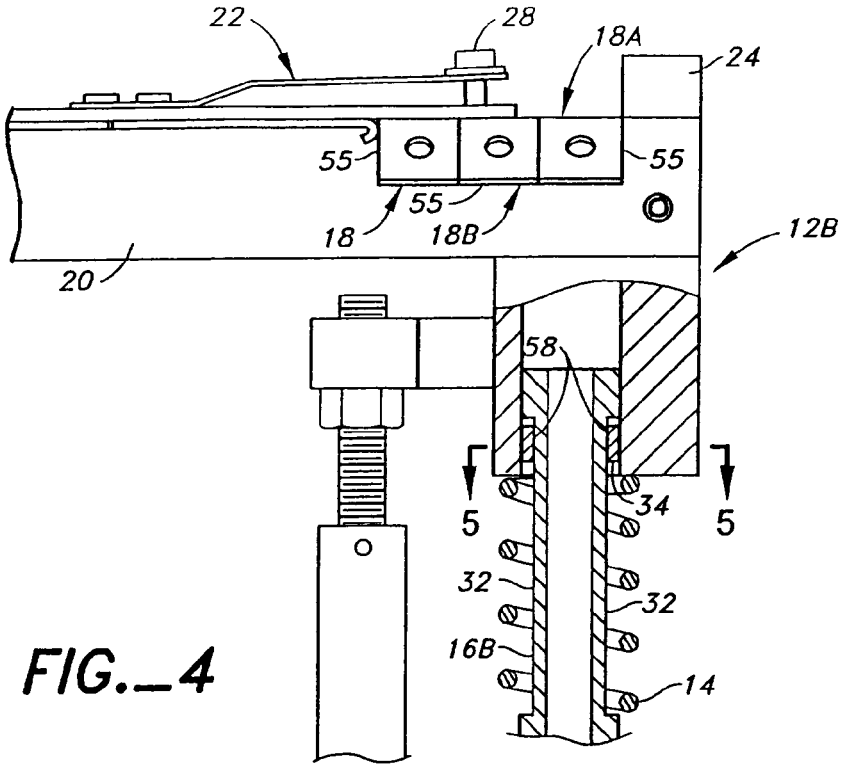
FIG. 4 illustrates another embodiment of a track assembly attached to the barrel of a power actuated gun.

FIG. 4 more clearly illustrates how the track assembly 12B is held onto barrel 16B of the power actuated gun 10. The U shaped bracket 34 rides within flat portion formed on the barrel 16B of the power actuated gun 10.

Figure 5:
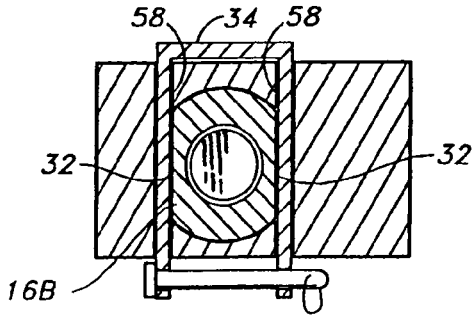
FIG. 5 is a cross section taken along lines 5—5 in FIG. 4.

FIG. 5 is a cross section taken along lines 5—5 in FIG. 4. In FIG. 5, the U shaped bracket 34 is clearly illustrated around the barrel 16B.

Figure 6:
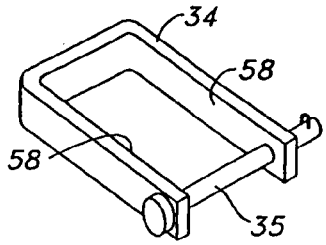
FIG. 6 illustrates a U bracket for attaching the fastener feeding assembly to the barrel of a power actuated gun.

FIG. 6 illustrates the U shaped bracket 34 off of the barrel 16B. After sliding over the barrel, the open end of the U shaped bracket 34 may be closed with a pin 35. The U shaped bracket 34 may also be closed with a bolt, or other equivalent means.

Figure 7:
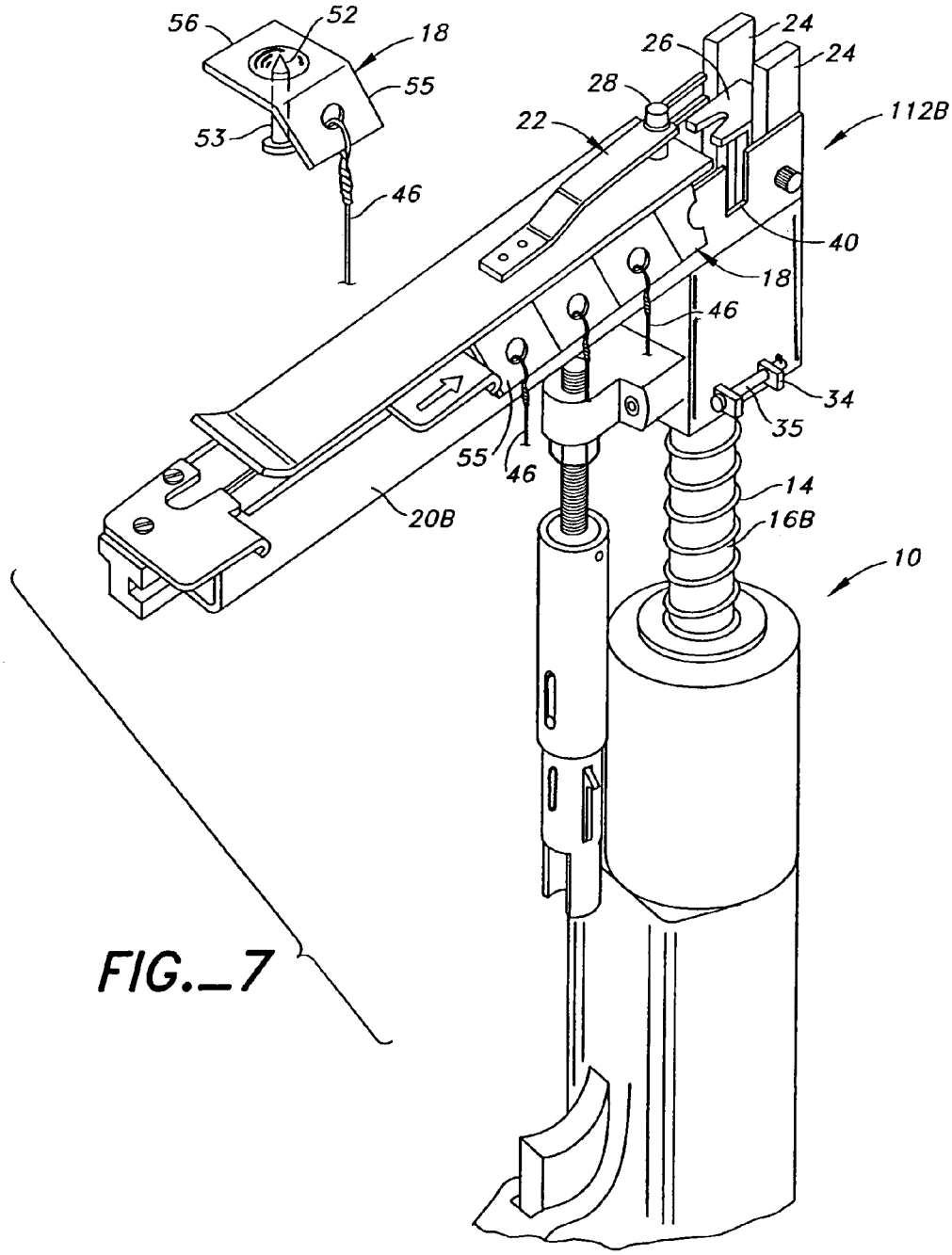
FIG. 7 illustrates another embodiment of a track assembly having a side opening in the track assembly for use with certain types of fastener assemblies.

FIG. 7 illustrates another embodiment of a track assembly 112B attached to the barrel 16B of a power actuated gun 10. In this embodiment, a side opening 40 is formed within the track 20B.

The side opening 40 has a width slightly less then the overall width of a fastener assembly 18. Accordingly, the fastener assembly 18 can still rest on edges of the track 20B; however, the side opening 40 permits clearance for a leg 55 of the fastener assembly 18, such that when the fastener assembly 18 is driven, there is adequate clearance for the leg and any wire 46 attached to the fastener assembly 18. In some situations, upon driving the fastener assembly 18, a leg 55 having the wire 46 attached thereto bends inward forming a substantially 90 degree angle. In some applications, this may contact the track 20B. The side opening 40 within the track 20B reduces the potential contact and helps prevent any possible jamming.

Also attached to barrel portion 16B is a trigger firing mechanism 38. The trigger firing mechanism 38 is positioned over a trigger 42 of the power actuated gun 10.

As shown in FIGS. 2 and 3, the track 12A contains a supply of fastener assemblies 18. Each fastener assembly 18, as shown in FIGS. 2 and 3 has a plate 56 and a nail 53 for being driven with the power actuated gun 10. Upon depressing the barrel portion 16A, the trigger firing mechanism 38 is lowered to contact the trigger 42 (see FIG. 1). At a predetermined point, the trigger firing mechanism 38 releases, pushing on trigger 42 firing the power actuated gun 10 and driving the nail 53 of the fastener assembly 18A into a substrate 44. The sequence is repeated and a fastener assembly 18B within track 12B is advanced.

The trigger firing mechanism 38 is illustrated attached to the fastener feeding track assembly 12B. The trigger firing mechanism 38 may contain any means for releasing upon contact with the trigger 42 to fire the power actuated gun 10.

FIG. 1 illustrates a fastener assembly 18 having a plate 56 with a nail or stud 53 therein, and a leg 55 attached to the plate 56. A wire 46 is shown attached to the leg 55.

I claim:

1. A power actuated gun having a fastener feeding track assembly attached thereto, the device comprising:

a. a barrel of the power actuated gun that is received by the fastener feeding track assembly;

b. the fastener feeding track assembly containing a plurality of loose fastener assemblies, each fastener assembly comprising a plate, a leg disposed at an angle to the plate, and a nail received within the plate, with at least portions of the leg of each fastener assembly disposed outside of the fastener feeding track assembly and to a side of the fastener feeding track assembly, the fastener feeding track assembly also having edges upon which the plates of the fastener assemblies rest so as to not fall toward the barrel of the power actuated gun and the fastener feeding track assembly having a window in the side of the fastener feeding track assembly where the barrel is received by the fastener feeding track assembly, wherein c. the window formed in the fastener feeding track assembly is large enough to create a clearance for the leg of the fastener assembly, should the leg bend toward the fastener feeding track assembly when the fastener assembly is driven by the power actuated gun, and wherein d. the window has a width slightly less than the overall width of the fastener assembly so that the fastener assembly can rest on the edges of the fastener feeding track assembly when the fastener assembly is positioned at the portion of the fastener feeding track assembly having the window.

* * * * *